US005341796A

United States Patent [19]

Beck et al.

[11] Patent Number: 5,341,796

[45] Date of Patent: Aug. 30, 1994

[54] TURN IN PLACE MOUNTING

[75] Inventors: Scott A. Beck; Rex R. Mills, both of Indianpolis; Timothy J. Waterman, Carmel, all of Ind.

[73] Assignee: Carrier Corporation, Syracuse, N.Y.

[21] Appl. No.: 143,451

[22] Filed: Oct. 26, 1993

[51] Int. Cl.[5] ..... F24H 3/02

[52] U.S. Cl. ..... 126/110 R; 126/116 A

[58] Field of Search ..... 126/110 R, 116 R, 116 A

[56] References Cited

U.S. PATENT DOCUMENTS 3,274,990 9/1966 MacCracken ..... 126/110 R

*Primary Examiner*—Carroll B. Dority

[57] ABSTRACT

A furnace for supplying circulated heated air to a comfort zone, the furnace having a condensing heat exchanger and a blower for moving ambient air over the heat exchanger, wherein a transformer for stepping down line voltage (115 VAC) to control voltage (24 VAC) is secured to the inner surface of an enclosed housing within the furnace wherein the inner wall also supports at least one retaining bracket and one fastenable support bracket. A first flange extending from the transformer engages the retaining bracket to rotatably support the transformer. A second flange extending from the transformer engages the fastenable support bracket to secure and further support the transformer supported within the housing. A threaded member secures the fastenable support bracket to the second flange, thereby preventing disengagement.

6 Claims, 3 Drawing Sheets

TURN IN PLACE MOUNTING

BACKGROUND OF THE INVENTION

1. Field of the Invention

This invention relates to a furnace for providing heated air to an interior comfort space, and is more particularly directed to a turn in place mounting for retaining a transformer to the shelf from which a furnace air blower is suspended.

2. Description of the Prior Art

In conventional gas-fired forced air furnaces a thermostat senses the temperature in the comfort zone relative to a predetermined set point temperature. When the comfort zone temperature is below the set point, the thermostat closes to supply thermostat ac power to the furnace as a call for heat. This initiates a sequence of events that ultimately causes the furnace to activate. An inducer motor is enabled, which in turn causes the flow of combustion air across the burners and through a heat exchanger, after which a gas valve is actuated to supply gas to the gas burners. At the same time, an ignition device is actuated to light the burners. A flame sensor then proves burner ignition and sends power to a blower delay timer. After a predetermined blower delay time, which varies with furnace design, the furnace blower is actuated. The blower moves circulated room air from a return air duct through the furnace heat exchanger to accept heat from the heated combustion products (carbon dioxide and water vapor) produced by the gas burners. The heated circulated air then goes into a hot air plenum and is distributed through hot air duct-work back to the comfort zone. When the comfort zone air is warmed sufficiently to reach the thermostat set point, the thermostat terminates the call for heat. When this happens the blower and burners go through a shut off sequence and the furnace awaits the next call for heat.

The air blower is suspended beneath a shelf located in the furnace and, in the prior art, the transformer was mounted either directly on the blower using a pair of screws or directly to a metal control box. The transformer steps down line voltage (115 VAC) to control voltage (24 VAC). Manufacturing the hardware necessary to secure the transformer had the disadvantage of being relatively complicated. Furthermore, installation and servicing of the transformer requiring two mounting screws proved difficult as two hands had to be used. The transformer had to be held in place with one hand while the other hand was securing it, via the first screw, to the mounting.

In the present invention, the transformer is mounted inside an enclosed housing that holds the air blower. Both the transformer and blower are suspended from an interior furnace wall. Multiple brackets are positioned inside the housing at varying distances from a fastenable bracket. Depending on the size of the transformer, a first flange on the transformer engages one of the multiple brackets whereby the transformer is rotatably supported. A second flange mounted on the transformer engages the fastenable support bracket. Transformer placement on both brackets fully supports the transformer and can be performed with one hand. The transformer will rest on the brackets for a sufficient duration to allow a single screw placed through a hole associated with the fastenable bracket to lock it in place.

The portion of the wall from which the transformer is mounted is formed out of the plane of the wall, away from the housing so that any condensate will run off this portion onto the rest of the wall and condensate will not percolate through the screw-hole onto the transformer.

In addition, because the mounting brackets are located within the blower housing, only a single screw protrudes outside of the housing. Thus drainage tubes may pass freely across the outside of the housing wall without interference from the mounting apparatus.

SUMMARY OF THE INVENTION

It is therefore a primary object of the present invention to provide an apparatus for mounting a transformer inside an enclosed housing within a furnace wherein more than one size of transformer can be accommodated.

It is another object of the instant invention to provide an apparatus for mounting a transformer within a housing so that moisture outside the housing will not be transferred to the transformer.

It is still another object of the instant invention to provide an apparatus for mounting a transformer within an enclosed housing using minimal hardware elements.

It is yet another object of the instant invention to provide an apparatus for mounting a transformer within an enclosed housing wherein the transformer may be easily installed or removed.

These and other objects of the present invention are attained by means of flanges mounted upon a transformer for engaging at least one retaining bracket and one fastenable support bracket, both of which are positioned inside a housing within a furnace on the same surface of a wall of the housing supporting a furnace blower. The section of the wall from which the brackets are mounted is formed out of the plane of the wall and away from the housing. Engagement of at least one bracket and a flange rotatably supports the transformer. Additional engagement of a second flange with the fastenable bracket supports fully the transformer so that a single fastener through the fastenable bracket and the flange engaged therewith prevents disengagement; therefore, the transformer is secured within the housing. When the fastener is removed, the transformer may be rotated for disengagement of the brackets and flanges, allowing the transformer be removed from the housing.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF THE INVENTION

Figure 1:
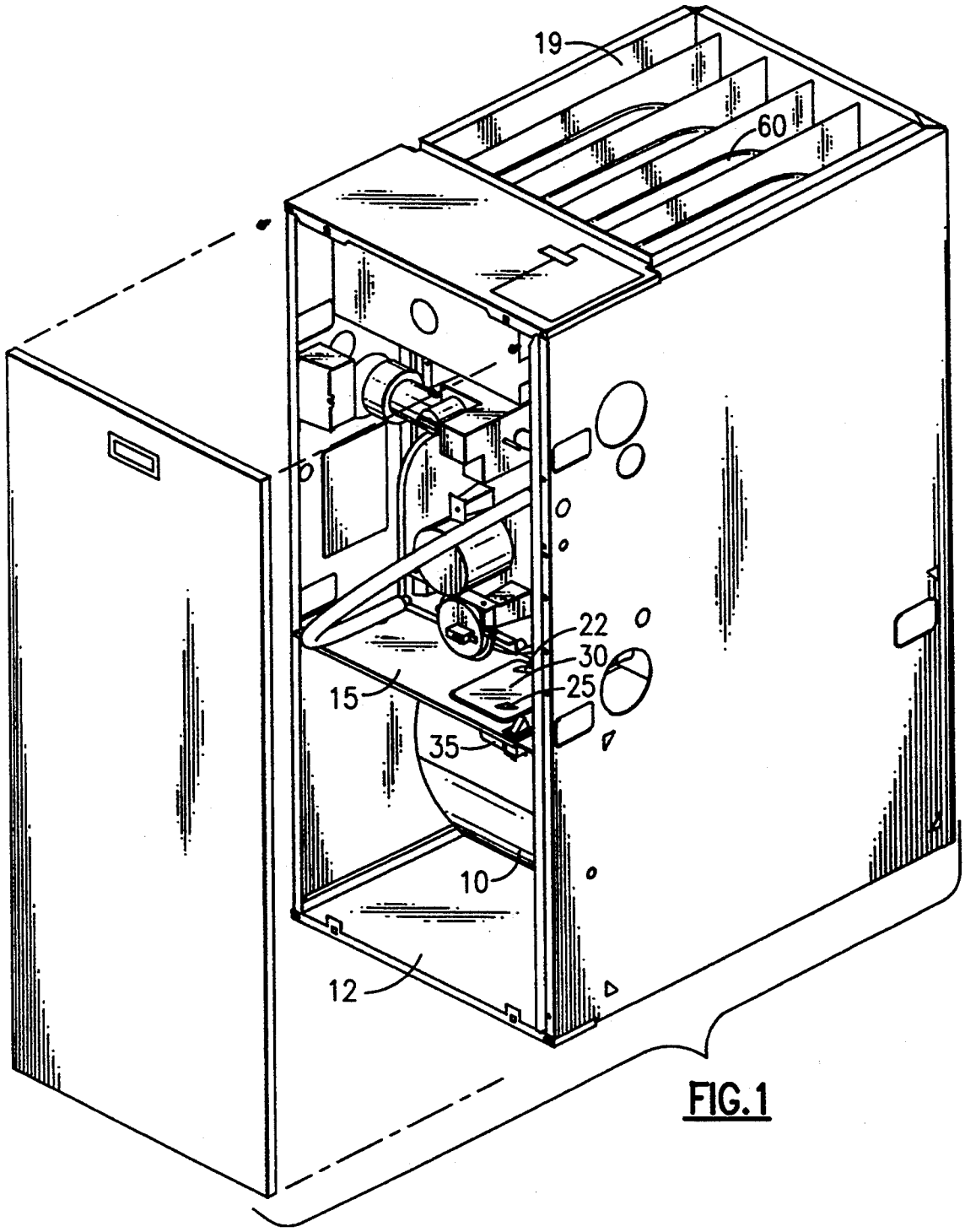
FIG. 1 is a perspective view of a furnace showing an embodiment of the present invention.

Referring initially to FIG. 1 there is illustrated a furnace, generally referenced 55, for supplying circulated heated air to a comfort zone. The furnace 55, is shown in an upflow orientation wherein a blower 10 draws ambient air into an enclosed housing 12 from a comfort zone and forces it over a heat exchanger 60. A wall of the housing 15 is completely enclosed within the furnace 55. A transformer 35, which steps down line voltage (115 VAC) to a control voltage (24 VAC) is mounted inside the housing 12 to the inner surface of the housing wall 15. The air continues through the furnace 55 and discharges from the top 19.

Figure 2:
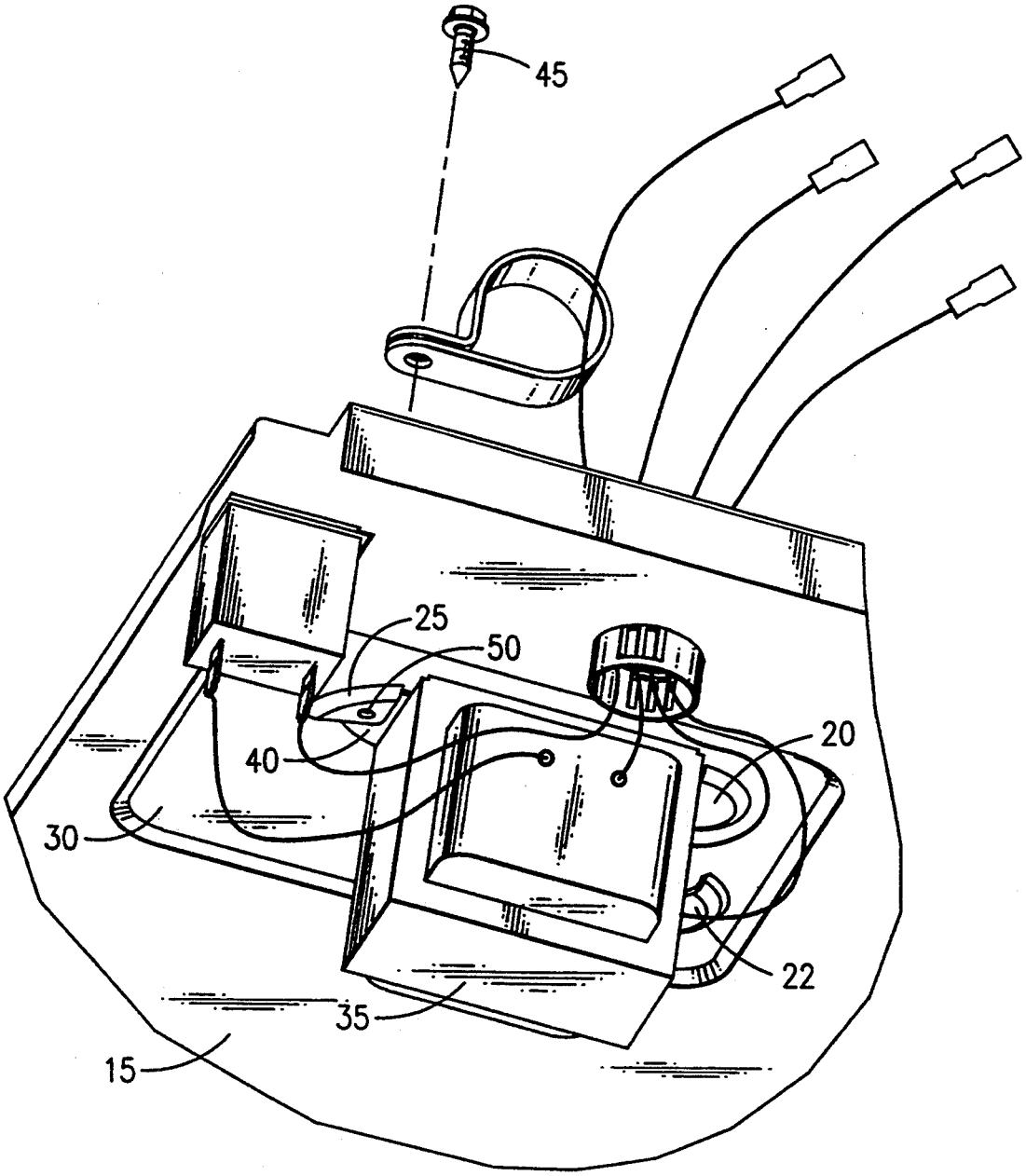
FIG. 2 is a sectional view of an inner surface of a wall of an enclosed housing within the furnace of FIG. 1.

FIG. 2 illustrates in detail the structure utilized to secure the transformer 35 to the inner surface of the shelf 15. A first semicircular bracket 20, located on the inner surface of the wall 15, receives a flange, not visible, extending from the transformer 35. The engagement of the bracket 20 and flange rotatably supports the transformer 35 so that the transformer 35 may be pivoted. A semi-circular shaped bracket, as shown in the embodiment, is particularly suited for allowing rotation of the transformer 35. Pivoting the transformer 35 in place causes a second flange 40 of the transformer to engage a fastenable support bracket 25, also located on the inner surface of the wall 15. Engagement of the brackets 20, 25 and transformer flanges, only one of which is visible 40, fully supports the transformer 35. The addition of a fastener, such as a screw 45, secures together the fastenable support bracket 25 and transformer flange 40, and retains the transformer 35 within the housing 12 on the housing wall 15.

Securing the transformer 35 to the wall 15 in this manner provides several advantages over the prior art. Because the transformer 35 and the supporting brackets 20, 25 are located within the housing 12, other furnace components, such as drainage tubes, may be positioned along the wall 15 outside the housing. With only a single screw 45 extending outside the housing, obstruction of furnace components is avoided.

Furthermore, the teachings of the present invention provide for simplified furnace assembly and service. Both installation and removal of the transformer 35 can be performed with one hand. Specifically, removal of the fastening device, namely the screw 45, does not result in an immediate requirement for external support of the transformer 35; the brackets 20, 25 continue to support the transformer 35. Only upon manual rotation of the transformer 35 does the second flange 40 disengage the fastenable bracket 25 allowing the transformer 35 to be removed from the semicircular bracket as well. The structural support provided by the brackets 20, 25 allows one-handed installation and removal of the transformer 35.

Supporting the transformer 35 as taught by the present invention, namely within the housing 12, protects the transformer 35 from condensate which may collect on the wall 15 as a result of a leaking condensing heat exchanger.

Additional protection of the transformer 35 from damaging condensate (if present) is obtained by providing a section 30 of the wall 15 that is formed out of the plane of the wall 15, away from the housing 12 thereby diverting the condensate from the transformer 35. The brackets 20 25 and, consequently, the transformer 35 are mounted to the inner surface of the formed outward section 30 of the wall 15. Without the formed outward section 30, the condensate would flow undiverted along the wall 15, down into the brackets 20 25, and to the transformer 35. The present invention prohibits such damaging moisture flow.

Figure 3:
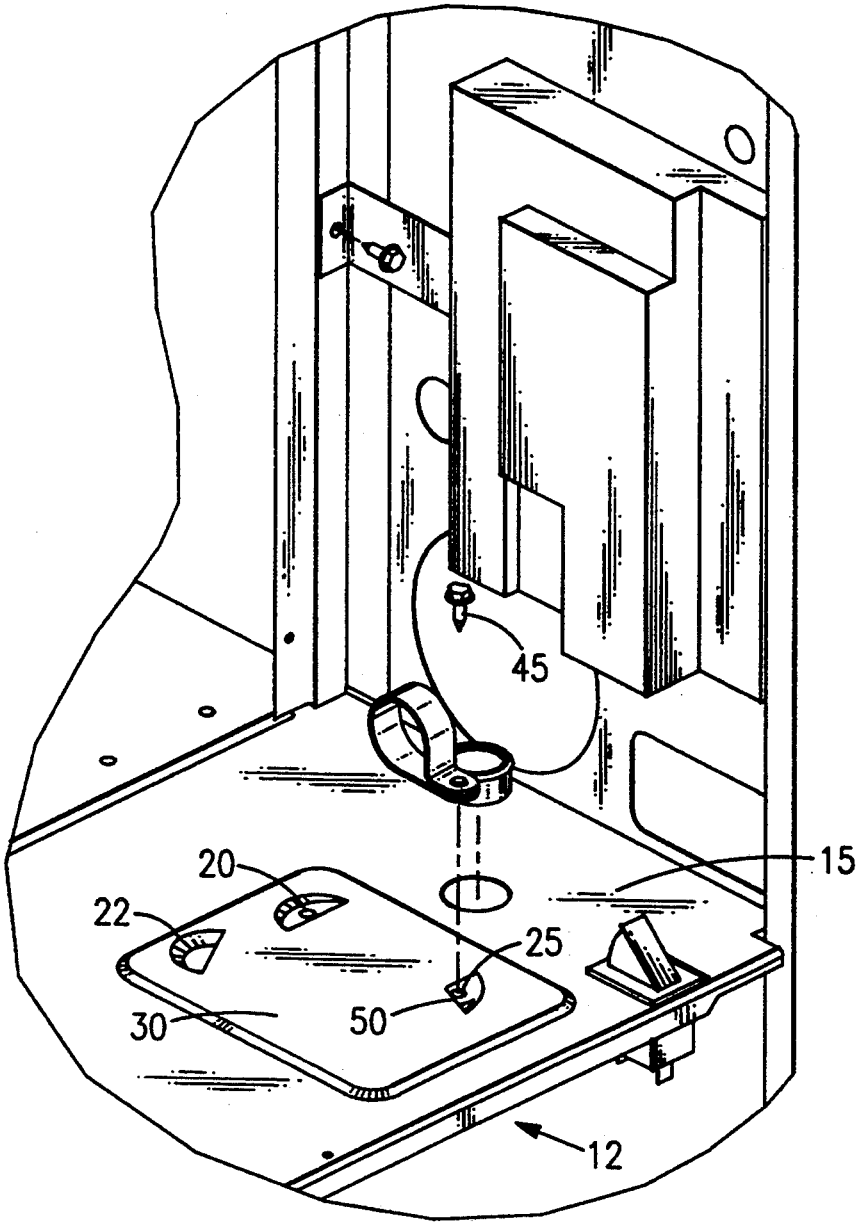
FIG. 3 is a perspective view of the outer surface of the wall of FIG. 2.

As can be seen most clearly in FIG. 3, the instant invention provides the additional advantage of being usable with more than one size of transformer. In the preferred embodiment, the use of two semicircular brackets 20 22 located at different, predetermined distances from the fastenable bracket 25 allows the housing wall 15 to accommodate transformers of two different sizes. Furthermore, the semicircular brackets 20, 22 are misaligned with the fastenable support bracket 25. The semicircular brackets are purposefully misaligned so that larger size transformers can be positioned without interference from those semicircular brackets located closer to the fastenable support bracket 25. Each semicircular bracket 20 22 can receive a flange of a transformer of predetermined size wherein that transformer is rotatably supported. Regardless of the size of the transformer, the fastenable bracket 25 receives a second flange 40 of the transformer 35 whereby the transformer is supported as discussed previously. Although not shown, the present invention may accommodate more than two different size transformers by providing additional semicircular brackets at predetermined distances from the fastenable bracket 25. Since the wall 15 may accommodate multiple transformers of predetermined size, only the one wall shown needs to be manufactured for use in furnaces utilizing these predetermined size of transformers.

While this invention has been explained with reference to the structure disclosed herein, it is not confined to the details set forth and this application is intended to cover any modifications and changes as may come within the scope of the following claims:

What is claimed is:

1. In a furnace of the type having a transformer for stepping down line voltage (115 VAC) to control voltage (24 VAC), wherein the furnace has an enclosed housing therein, the housing having a wall completely enclosed within the furnace wherein said wall has an inner and outer surface; and the blower is secured within the housing to the inner surface of said wall, the furnace including, at least one retaining member extending from the inner surface of said wall, said at least one retaining member engaging a first flange on the transformer to rotatably support said first flange;

a fastenable support member extending from said wall so that upon rotation of the transformer said fastenable support member engages a second flange of said transformer to further support the transformer; and fastening means for securing said fastenable retaining member to said second flange.

2. The apparatus of claim 1 wherein said at least one retaining member includes at least one semicircular retaining bracket and said fastenable support member further includes a partial disc shaped fastenable bracket.

3. The apparatus of claim 1 wherein a section of said wall is formed out of the plane of said wall and away from said housing to divert the flow of moisture along the outer surface of said wall.

4. The apparatus of claim 1 wherein said fastening means comprises a threaded fastener.

5. The apparatus of claim 1 wherein said at least one retaining member includes a plurality of semicircular brackets for accommodating alternative size transformers wherein each of said semicircular brackets is located at a predetermined distance from said fastenable support member, and wherein said semicircular brackets are staggered so that said multiple semicircular brackets are out of alignment with any one other of said multiple semicircular brackets and said fastenable support member.

6. The apparatus of claim 3 wherein said at least one retaining member and said fastenable support member are mounted to said section of said wall.

* * * * *